US005651340A

United States Patent [19]

Schwaderlapp et al.

[11] Patent Number: 5,651,340

[45] Date of Patent: Jul. 29, 1997

[54] PISTON INTERNAL COMBUSTION ENGINE WITH REINFORCED ENGINE BLOCK USING SEGMENTED RIBS

[75] Inventors: Markus Schwaderlapp, Stolberg; Christian Schoenherr; Thomas Wagner, both of Aachen, all of Germany

[73] Assignee: FEV Motorentechnik GmbH & Co. Kommanditgesellschaft, Aachen, Germany

[21] Appl. No.: 501,058

[22] PCT Filed: Dec. 9, 1994

[86] PCT No.: PCT/EP94/04098

§ 371 Date: Oct. 4, 1995

§ 102(e) Date: Oct. 4, 1995

[87] PCT Pub. No.: WO95/16120

PCT Pub. Date: Jun. 15, 1995

[30] Foreign Application Priority Data

Dec. 11, 1993 [DE] Germany ..... 9319055 U

[51] Int. Cl.[6] ..... F02F 7/00

[52] U.S. Cl. ..... 123/195 R

[58] Field of Search ..... 123/195 R

[56] References Cited

U.S. PATENT DOCUMENTS

| | | | |
|---|---|---|---|
| 3,817,354 | 6/1974 | Meiners | 184/104 B |
| 3,941,114 | 3/1976 | Seifert | 123/195 R |
| 3,977,385 | 8/1976 | Mansfield | 123/195 R |
| 4,452,192 | 6/1984 | Hayashi | 123/195 R |
| 4,470,376 | 9/1984 | Hayashi | 123/195 R |
| 4,515,112 | 5/1985 | Tsuchiya et al. | 123/195 R |
| 4,777,912 | 10/1988 | Fischer et al. | 123/41.79 |
| 4,903,646 | 2/1990 | Minagawa et al. | 123/195 R |
| 5,218,938 | 6/1993 | Miller et al. | 123/195 H |
| 5,253,615 | 10/1993 | Heater et al. | 123/195 R |
| 5,404,847 | 4/1995 | Han | 123/3 |

FOREIGN PATENT DOCUMENTS

| | | |
|---|---|---|
| 0 052 818 | 6/1982 | European Pat. Off. . |
| 0 064 457 | 11/1982 | European Pat. Off. . |
| 28 49 613 | 5/1979 | Germany . |
| 28 01 431 | 6/1979 | Germany . |
| 3544215 | 6/1986 | Germany . |
| 40 17 139 | 12/1991 | Germany . |

*Primary Examiner*—David A. Okonsky
*Attorney, Agent, or Firm*—Spencer & Frank

[57] ABSTRACT

A piston internal combustion engine includes an engine block made of a base material and including a cylinder block having walls. Segmented, rib shaped reinforcements are disposed on the engine block, each reinforcement defining breaks along a course thereof, the reinforcements further being made of a material having a higher modulus of elasticity than the base material.

8 Claims, 1 Drawing Sheet

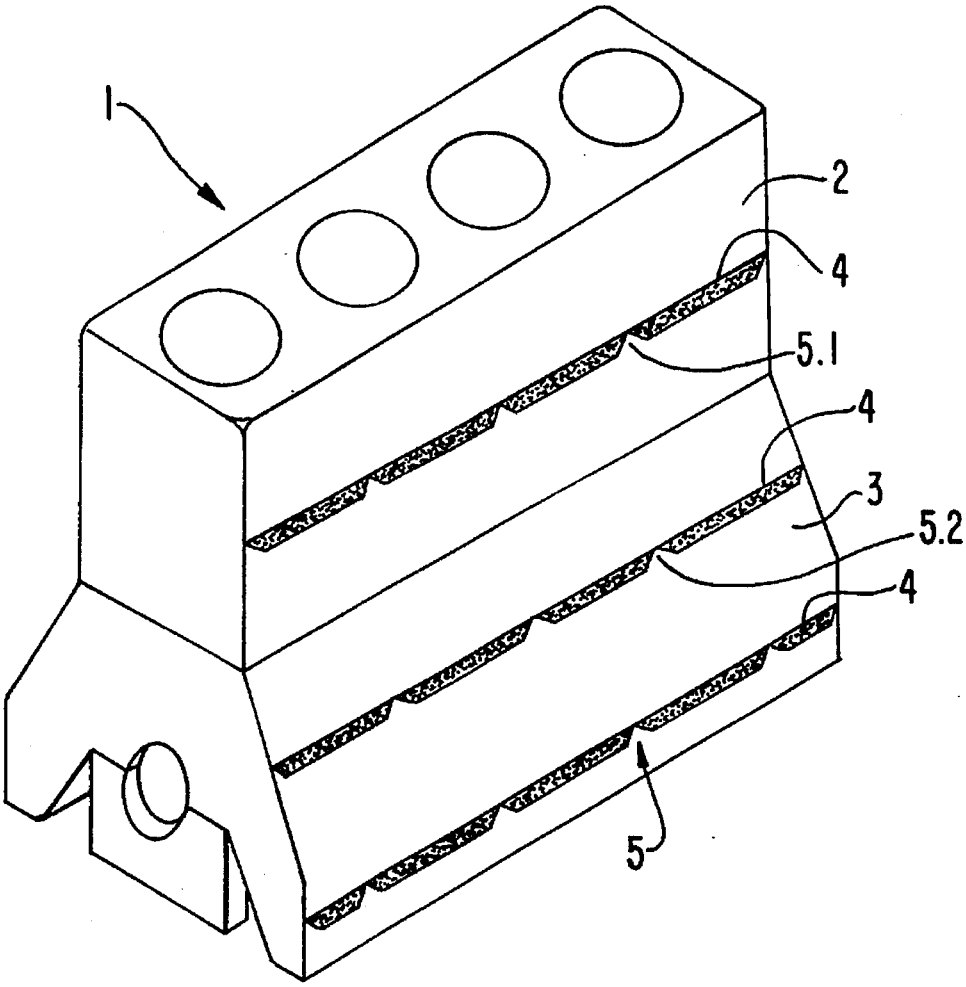
1
2
4
5.1
4
3
5.2
4
5

PISTON INTERNAL COMBUSTION ENGINE WITH REINFORCED ENGINE BLOCK USING SEGMENTED RIBS

BACKGROUND OF THE INVENTION

In operation, piston engines, in particular piston internal combustion engines, are excited to vibrate as a function of the changing events in the cylinder chamber, such as the course of combustion, but also as a function of mechanical influences. The vibrations are also radiated as noise at the surfaces of the piston engine in the form of airborne noise, and/or are transmitted via the bearings of the piston engine into the substructure or into the body in vehicles as structure-borne sound.

Abatement of noise emissions of the above kind is sought, because of their negative effects on humans and the environment. DE-A-28 49 613 attempts to produce a noise shield by disposing an elastic acoustical insulation enclosure, which is attached to the engine block of a piston internal combustion engine. Furthermore, DE-A-28 01 431 suggests supporting the entire piston internal combustion engine in an outer tublike casing with the aid of support elements, which insulate structure-borne sound. A disadvantage of such an acoustical insulation measure is that it contains a large part of the machine and therefore hinders the installation of add-on parts and/or additional units, such as engine mounts, starter, generator, or gas supply lines and gas exhaust lines. In this connection, in many cases, it is impossible to prevent the breaching of acoustical insulation enclosures of the above kind in order to install add-on parts of the same kind and/or additional units, which measure reduces the effectiveness of the arrangement. Furthermore, acoustical insulation measures of the above kind reduce the heat tolerance of a piston internal combustion engine.

On account of the above mentioned disadvantages, there have been attempts to control noise propagation by seeking to prevent or at least to reduce the generation of noise. In addition to reducing sources of excitation, for example by optimizing the combustion process, it makes sense primarily to reduce the noise transmission and noise radiation at the surfaces of the piston engine. The above is achieved by configuring the piston engine to be as rigidly as possible, particularly making it resistant to bending, or torsionally rigid, especially in its thin-walled regions; the oscillatory faces are configured to be as small and/or thick-walled as possible with regard to airborne noise radiation. According to the above arrangement, however not only is there then an undesired increase in weight, particularly resulting from an increase in wall thickness, primarily in cast components, but increased casting defects such as bubbles or pores or the like also occur. DE-A-35 44 215 has already suggested improving the rigidity of the engine block as a whole with a system of reinforcement ribs on the side walls in the cylinder region. As a result, undesired casting defects can be prevented by configuring the ribs in this way, and high rigidity of the cylinder block can be achieved.

DE-A-40 17 139 suggests the concept of achieving the required rigidity of the engine block via the purposeful installation of bands and ribs. According to this proposal, the above is achieved in particular by binding the crankshaft bearings to the cylinder block and to the side walls of the crankcase via a multitude of reinforcing ribs, so that the rigidity of the engine block structure as a whole is increased. However, the above arrangement entails a corresponding increase in weight. However, from an economical standpoint, a weight increase is to be avoided.

SUMMARY OF THE INVENTION

The object of the invention, is to reduce the vibration and noise generation of a piston engine, in particular of a piston internal combustion engine, by the design of the engine block structure without increasing the overall weight if at all possible.

The above object is attained according to the invention with a piston engine, in particular a piston internal combustion engine, in which cylinders, pistons, the crankshaft, and crankshaft bearings are disposed in an engine block, and regions on the engine block are provided with cap- and/or cup-shaped coverings, and in which the walls of the engine block and/or the coverings, are provided, at least in some regions, with rib-shaped reinforcements which run in a segmented line. The particular advantage of the invention is that the free oscillatory outer faces of the engine block structure are reduced, and the acoustic behavior of the engine block structure is audibly improved. Ribs of the above kind lead to an increased impedance discontinuity at the break points between segments, and consequently lead in particular to a reduction in the transmission of structure-borne sound. The geometry of the break points can for example be as wedge-shaped, trapezoidal, or rounded.

In terms of the present invention, the coverings include, for example, the cylinder head cover, control drive coverings, the crankcase or oilpan, and similar elements of the engine structure. With a view to reducing noise, which is the object of the present invention, in particular in piston internal combustion engines, the transmissions connected to the engine also have to be taken into account, since even the walls of a flange mounted transmission case, for example, can radiate noise. Here, too, a vibration reducing reinforcement can be achieved with an arrangement of components in the wall. In the same manner, the intake and/or exhaust pipes can be reinforced in a vibration reducing manner on the inside with tubular components and/or on the outside with strut- or rib-shaped components, so that via these structures, which in the broad sense belong to the engine block, no noise radiation or only slight noise radiation is produced.

The rib-shaped reinforcements can be comprised of the base material of the engine block, for example cast with cast engine blocks or engine block parts.

In one embodiment of the invention, for the rib-shaped reinforcements, materials which have a higher modulus of elasticity than the base material of the engine block can be provided, these being particularly ceramic materials. These materials have a much higher modulus of elasticity than the standard gray cast iron or cast aluminum used for the base material. In the event that gray cast iron is used as the base material, the density of ceramic materials is essentially lower than the density of the base material. With the use of cast aluminum, the density of the ceramic materials is approximately the same. Because of these material properties, reinforcing components of ceramic materials, with the same mass, can produce approximately twelve times the rigidity compared to a structurally similar embodiment of gray cast iron. For the same rigidity, for example, ribs of a ceramic material have approximately 70% less mass than ribs of gray cast iron. A further advantage is that with a rib-shaped embodiment of such components, with a predetermined equal rigidity given the higher modulus of elasticity, the geometric dimensions are reduced compared to a rib of the base material, so that the structural volume of the engine is reduced. Reinforcing measures for noise reduction can therefore be effectively introduced into the components, even with an existing production system.

BRIEF DESCRIPTION OF THE DRAWING

The invention will be explained in further detail in terms of an exemplary embodiment, in conjunction with a schematic drawing of an engine block according to the invention.

DETAILED DESCRIPTION OF THE INVENTION

In the drawing, an engine block 1 of a four-cylinder piston internal combustion engine is shown, whose upper section constitutes the cylinder block 2 and whose lower section constitutes the upper part of the crankcase 3. The crankcase 3 is enclosed on the underside with a tublike crankcase bottom, not shown. The cylinder block 2 and the crankcase 3 are embodied as one component, particularly in vehicle engines. To reinforce the structure, rib-shaped reinforcements, which extend in the longitudinal direction of the engine, are disposed on the cylinder block 2 and likewise on the crankcase 3. These rib-shaped reinforcements 4 can be comprised of the base material of the engine block 1 and can be joined by material adhesion, for example by the casting process. They can also be comprised of a material, which has a higher modulus of elasticity than the base material, preferably of a ceramic material. If the engine block 1 is made for example of gray cast iron, then compared to the gray cast iron base material, the reinforcements 4 have for example a modulus of elasticity approximately three times higher than and about half the density of the base material. The thermal expansion coefficient is similar to that of gray cast iron, so that a composite of gray cast iron and ceramic is not problematic from this standpoint. If aluminum is used as the base material, the reinforcements 4, for example with the use of aluminum oxide ceramic, have a modulus of elasticity five times higher than the base body at a similar density. Thus when gray cast iron is used for the base body, for example, the above kind of ceramic rib-shaped reinforcement 4, as shown in the drawing, has around 70% less mass than ribs of gray cast iron, with the same inherent stability. Rib-shaped reinforcements of the above kind can be disposed on the crankcase 3, both on the outer wall and on the inner wall. In the apparatus shown, the rigidity of the engine block increases globally and above all, locally in particular with regard to the vertical engine axis so that the production of vibrations is hindered and the amplitude of the produced vibrations of the engine block is decreased.

As can be seen in the drawing, the rib-shaped reinforcements 4, which extend in the longitudinal direction, are interrupted or segmented in their longitudinal direction; the breaks 5 are provided preferably in the region of the connecting points of the bearing walls with the outer walls of the engine block, that is, in locations at which structurally required wall thickenings are provided anyway. Thus, the free oscillatory outer faces of the engine block structure are reduced in size, and the acoustic behavior of the engine block structure is audibly improved. Rib courses which are segmented in this way lead to an increased impedance discontinuity at the break points 5 and consequently to a reduction of structure-borne sound transmission. The geometry of the break points can be wedge-shaped or trapezoidal, as shown for example for the region 5.1, or can be rounded, as shown for the region 5.2.

The rib-shaped reinforcements can be provided in larger wall faces on the engine block or also on its various cap- and/or cup-shaped coverings, even in a crosswise disposition. It is important only that they are each segmented in their longitudinal span.

If the rib-shaped reinforcements are comprised of a material other than the base material, these can be connected to the relevant regions of the engine block by recasting, gluing, soldering, or welding.

We claim:

1. A piston internal combustion engine, in which cylinders, pistons, crankshaft, and crankshaft bearings are disposed in an engine block made of a base material, wherein regions on the engine block are provided with at least one of cap-shaped and cup-shaped coverings in which at least one of walls of the cylinder block and the coverings, at least in some regions, are provided with segmented, rib-shaped reinforcements defining breaks therein, and wherein a ceramic material for the rib-shaped reinforcements with a higher modulus of elasticity than the base material of the engine block is used.

2. The piston engine according to claim 1, characterized in that the breaks in the rib-shaped reinforcements are each provided in regions of structurally required wall thickenings.

3. A piston internal combustion engine comprising:

an engine block made of a base material and including a cylinder block having walls; and segmented, rib shaped reinforcements disposed on the engine block, each reinforcement defining breaks along a course thereof, the reinforcements further being made of a material having a higher modulus of elasticity than the base material.

4. The piston internal combustion engine according to claim 3, further comprising coverings coupled to predetermined regions of the engine block, wherein the reinforcements are disposed on at least one of the coverings and the walls of the cylinder block.

5. The piston internal combustion engine according to claim 4, wherein the coverings are at least one of cap-shaped and cup-shaped.

6. The piston internal combustion engine according to claim 3, wherein:

the engine block includes thickened walls at predetermined portions thereof; and the reinforcements are disposed on the engine block such their breaks are located at the predetermined portions of the engine block which include the thickened walls.

7. The piston internal combustion engine according to claim 3, wherein the material having a higher modulus of elasticity than the base material comprises a ceramic material.

8. The piston internal combustion engine according to claim 6, wherein the material having a higher modulus of elasticity than the base material comprises a ceramic material.

* * * * *